US006282403B1

(12) United States Patent
Spencer et al.

(10) Patent No.: US 6,282,403 B1
(45) Date of Patent: Aug. 28, 2001

(54) DECURLER ROLL SETUP AND WEAR RATE DETERMINATION PROCEDURE

(75) Inventors: Stan Alan Spencer, Rochester; Jack G. Elliot, Webster; Leonid Buchman, Rochester, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/562,208

(22) Filed: May 2, 2000

(51) Int. Cl.[7] ..... G03G 15/00

(52) U.S. Cl. ..... 399/406; 74/63; 100/47; 162/271; 271/272; 340/675

(58) Field of Search ..... 399/406, 16; 162/271; 271/270, 272, 273, 274; 100/47; 226/176, 177, 186; 340/670, 674, 675; 74/63

(56) References Cited

U.S. PATENT DOCUMENTS 4,632,533 12/1986 Young .
5,392,106 * 2/1995 Bigenwald et al. ..... 399/406
5,539,511 7/1996 Wenthe, Jr. et al. .

FOREIGN PATENT DOCUMENTS 3-259846 * 11/1991 (JP) ..... 271/270

* cited by examiner

*Primary Examiner*—Joan Pendegrass
(74) *Attorney, Agent, or Firm*—Fay, Sharpe, Fagan, Minnich & McKee, LLP

(57) ABSTRACT

The present invention is useful in a nip-forming apparatus including a first roll and a second roll, wherein one of the rolls is displaceable toward the other to control the position of the first roll relative to the second roll, and wherein one of rolls is driven and the other is rotatable. The invention defines a setup procedure that includes rotating the driven roll and sensing a rotational speed of the rotatable roll. While the driven roll is rotating, the displaceable roll is displaced to a home displacement position relative to the other roll, wherein the home displacement position corresponds to a displaced position of the displaceable roll where the rotatable roll rotates at a select speed in response to contact with the driven roll. This home displacement position is then recorded. The invention is particularly well-suited for setup of a sheet decurler in an image forming apparatus. Change in the home displacement position over time due to roll wear is monitored and used to predict roll failure.

14 Claims, 7 Drawing Sheets

DECURLER ROLL SETUP AND WEAR RATE DETERMINATION PROCEDURE

BACKGROUND OF THE INVENTION

The present invention relates generally to a setup and wear determination procedure and apparatus for a sheet decurler in an electronic reprographic image forming apparatus. The invention is particularly adapted for use and will be described in connection with the setting up and wear monitoring of a decurler that decurls paper or other image recording sheets by passing same between a relatively soft elastomeric roll and a relatively hard pinch or penetrating roll. Those of ordinary skill in the art will recognize that the invention has broader application, and it is not intended that the invention be limited to the particular environment disclosed herein. The invention has application to any nip-forming device including a pair of parallel rollers that must be precisely positioned relative to each other, and the rollers can also be equally hard or soft.

It is generally known to pass a sheet of paper or another image recording sheet through a nip defined between a relatively soft roll and a relatively hard roll (the hard roll is referred to herein as the pinch roll or penetrating roll), and to control the amount of sheet decurling by controlling the degree to which the pinch roll penetrates into the associated soft roll. In modern high-speed image forming apparatus, decurling assemblies of this type must be adapted for rapid and accurate adjustment of pinch roll penetration. Furthermore, even extremely small variances in pinch roll penetration can alter the amount of decurling. In one modern image forming apparatus, the entire penetration range, from a simple paper transport position (no sheet decurling) to a maximum decurling penetration (maximum sheet decurling) is encompassed by only 0.5 millimeters (mm).

Unfortunately, in manufacturing the pinch roll, the soft roll, associated mounting components, and the other components used to control the position of the soft roll relative to the pinch roll, and also in assembly, dimensional tolerances on these components "stack-up" and require a decurler setup procedure so that penetration amounts can be accurately controlled. That is, the position of the soft roll relative to the pinch roll must be exactly known in order to adjust same accurately to achieve the desired pinch roll penetration.

Furthermore, the soft roll is typically manufactured using an elastomer or the like, and abrasion caused by the driven pinch roll and by the sheets, themselves, results in significant wear. Without a periodic decurler setup procedure, the soft roll wear would quickly result in penetration errors and, ultimately, early replacement of the soft roll. Furthermore, a need has been identified for a method and apparatus for assessing the wear rate of the soft roll so that its eventual exhaustion can be predicted to an operator of the image forming apparatus so that a service call can be scheduled in advance.

SUMMARY OF THE INVENTION

The present invention is useful in a nip-forming apparatus including a first roll and a second roll, wherein one of the rolls is displaceable toward the other to control the position of the first roll relative to the second roll, and wherein one of rolls is driven and the other is rotatable. The invention defines a setup procedure comprising rotating the driven roll and sensing a rotational speed of the rotatable roll. While the driven roll is rotating, the displaceable roll is displaced to a home displacement position relative to the other roll, wherein the home displacement position corresponds to a displaced position of the displaceable roll where the rotatable roll rotates at a select speed in response to contact with the driven roll. This home displacement position is then recorded.

In accordance with another aspect of the present invention, a method of controlling a decurling apparatus that comprises a cylindrical pinch roll and a cylindrical second roll is defined. The method includes: (a) driving one of the rolls about a longitudinal axis; (b) moving one of the rolls into contact with the other of the rolls to a select home position where the driven roll contacts and rotates the other roll at a select speed; (c) recording the home position; (d) moving the rolls relative to the home position at least one of toward and away from each other to control an amount by which a harder one of the rolls penetrates a softer one of the rolls to control an amount of decurling in a sheet that passes between the rolls.

In accordance with yet another aspect of the invention, an apparatus for controlling a cylindrical pinch roll and a cylindrical second roll of a decurling apparatus is defined. The apparatus includes means for driving one of the rolls about a longitudinal axis, and means for moving one of the rolls into contact with the other of the rolls to a select home position where the driven roll contacts and rotates the other roll at a predetermined select speed. The apparatus further includes means for recording the home position, and means for moving the rolls relative to the home position at least one of toward and away from each other to control an amount by which a harder one of the rolls penetrates a softer one of the rolls to control an amount of decurling in a sheet that passes between the rolls.

One advantage of the present invention resides in the provision of a decurler roll setup procedure and apparatus.

Another advantage of the present invention is found in the provision of a method and apparatus for assessing the wear rate of the elastomer roll in a decurler and for predicting failure of the elastomer roll based upon the determined wear rate.

A further advantage of the present invention is the provision of a method for assessing the wear rate of the elastomer roll in a sheet decurler of an image forming apparatus, wherein the method includes warning an operator of the image forming apparatus in advance that a new elastomer roll will soon be required.

Still another advantage of the present invention is the provision of a decurler roll setup method and apparatus that result in improved quality sheet decurling due to more accurate pinch roll penetration control.

A still further advantage of the present invention resides in the provision of a decurler roll setup procedure and apparatus that extend the useful life of the elastomer roller in a sheet decurler by compensating for roll wear.

Still other benefits and advantages of the present invention will become apparent to those of ordinary skill in the art upon reading and understanding the following specification.

BRIEF DESCRIPTION OF THE DRAWINGS

The invention takes form from a variety of components and arrangements of components, and from a variety of steps and arrangements of steps, preferred embodiments of which are illustrated in the accompanying drawings that form a part hereof and wherein.

DESCRIPTION OF PREFERRED EMBODIMENTS

Figure 1:
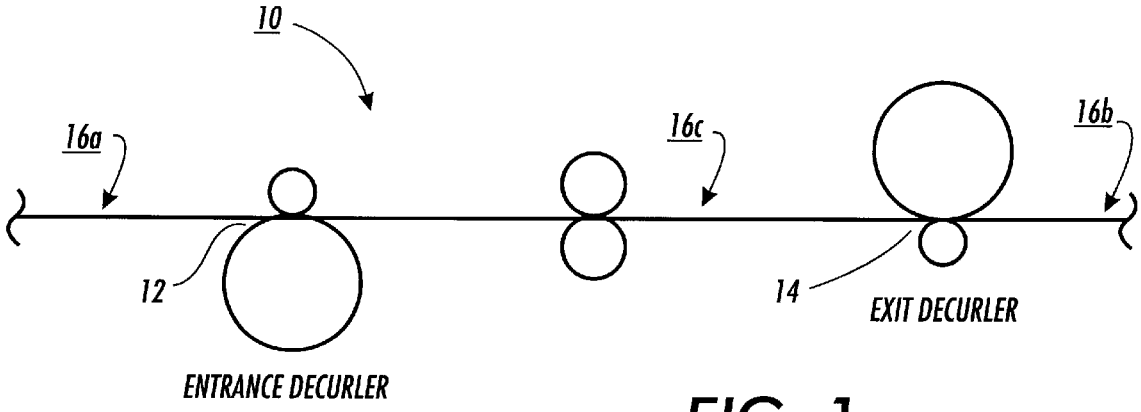
FIG. 1 is a diagrammatic illustration of a sheet decurling module of an image forming apparatus.

Referring now to the drawings, wherein the showings are for purposes of defining preferred embodiments only and not for purposes of limiting the present invention, a sheet decurling module of the type in connection with which the present invention can be advantageously employed is identified generally at 10. The decurling module, itself, does not form a part of the present invention and, thus, its structure and operation are described only briefly here. The illustrated module includes a first or entrance decurler 12 that receives sheets from an entrance sheet transport 16*a* or other location and that decurls a sheet with a downward curl, and a second or exit decurler 14 that decurls sheets with an upward curl and supplies sheets to an exit sheet transport 16*b*, an output tray, or other location. Sheets are transported from the entrance decurler 12 to the exit decurler 14 by an intermediate sheet transport 16*c*. The entrance decurler 12 is adapted to decurl a sheet in a first direction and the exit decurler 14 is adapted to decurl a sheet in a second, opposite direction. The entrance and exit decurlers are typically substantially similar or identical, but oriented oppositely.

Figure 2A:
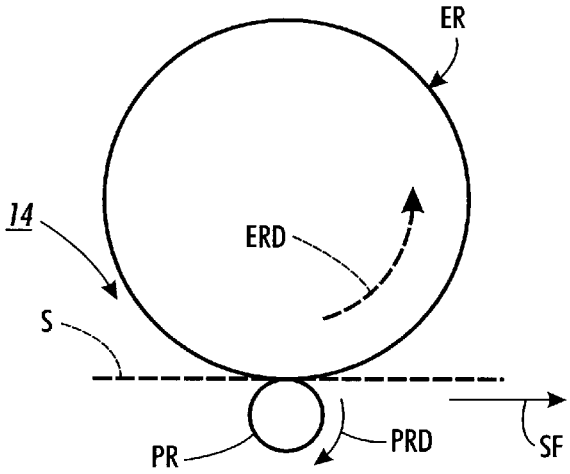
FIGS. 2A and 2B are enlarged diagrammatic illustrations of a sheet decurler in connection with which the apparatus and method of the present invention can be advantageously employed.
Figure 2B:
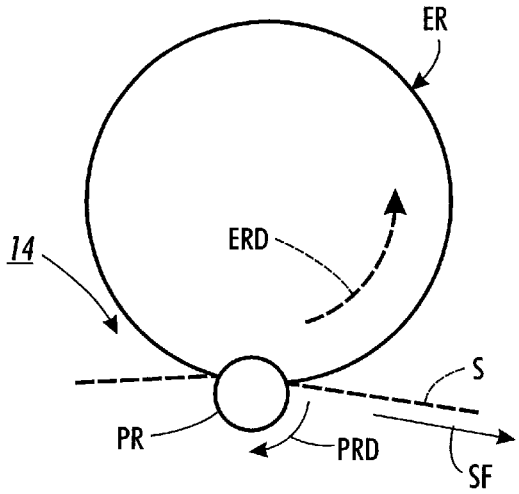

Referring now also to FIGS. 2A and 2B, the exit decurler 14 is illustrated in further detail. The decurler comprises an elongated (at least as long as a sheet to be decurled), cylindrical pinch (or penetrating) roll PR, typically defined from a durable metal such as steel or another relatively hard material, and a parallel elongated, elastomer roll ER including an outermost cylindrical surface defined from or comprising an elastomer or other suitable soft, resilient material. The space separating the rotational axes of the pinch roll PR and elastomer roll ER is adjustable, typically by displacing the elastomer roll ER, to control the amount by which the pinch roll penetrates into the soft surface of the elastomer roll and, thus, the amount of decurling toward the pinch roll. Furthermore, only one of the rolls PR,ER, is driven, and typically it is the pinch roll PR that is driven in a direction as disclosed herein and indicated by the arrow PRD. The other roll, here the elastomer roll ER, is rotatably supported and rotates or spins in a direction indicated by the broken arrow ERD when contacted by the pinch roll PR. A paper or other sheet S is transported in a sheet feed direction SF by and between the rollers PR,ER.

FIG. 2A illustrates the elastomer roll ER in a first position wherein it is in contact with the pinch roll PR and being driven thereby, but with minimal penetration of the pinch roll into the elastomer roll so that the sheet S is merely transported between the rollers PR,ER with little or no decurling. On the other hand, FIG. 2B illustrates the elastomer roll ER in a second position wherein it is deeply penetrates by the pinch roll to both transport and decurl the sheet S. As is generally well known, as the pinch roll PR penetrates the elastomer roll ER deeper, the amount of decurling (curling in a direction opposite to already present sheet curl) increases.

Figure 3:
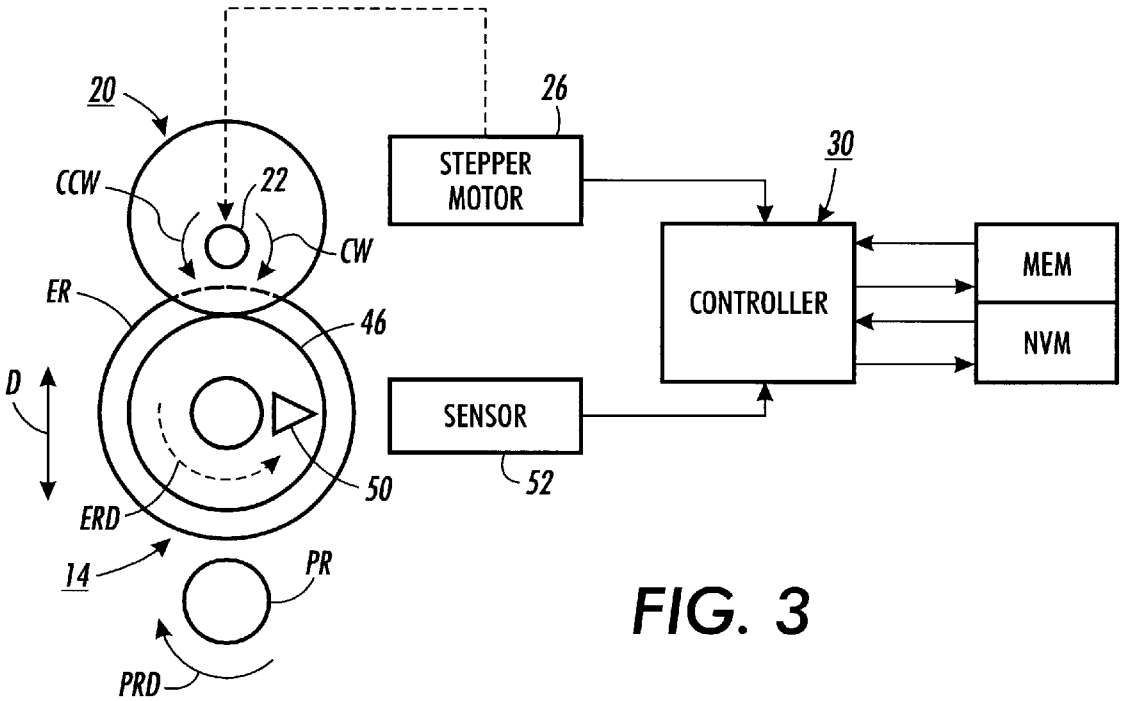
FIG. 3 is a diagrammatic illustration of a decurler setup and wear rate determination apparatus formed in accordance with the present invention.

Turning now to FIG. 3, an apparatus for setup of a decurler and monitoring wear of an elastomer roll in accordance with the present invention is illustrated with reference, by way of example only, to the decurler 14 of the sheet decurling module 10. The apparatus comprises a cam 20 adapted for rotation on a shaft 22 in a first, counterclockwise direction CCW and a second, clockwise direction CW. A stepper motor 26 or other suitable driving means is used to rotate the cam 20 in response to control signals received from a decurler controller 30 that can be any suitable electronic controller or microprocessor. The controller 30 is operably connected to electronic memory MEM including non-volatile memory NVM.

The cam 20 is used to control the position or displacement of the elastomer roll ER relative to the driven pinch roll PR as indicated by the double-ended arrow D. Specifically, the elastomer roll is biased by springs or otherwise into a position spaced-apart from the pinch roll PR as shown. A cam follower 40 is connected to the elastomer roll ER and is also connected to rotate with the elastomer roll when the elastomer roll is driven by the pinch roll PR. Rotation of the cam 20 in either the first direction CCW or second direction CW alters the height of the cam 20 between the shaft 22 and the follower 40 to either allow the elastomer roll to be biased farther away from the pinch roll or to urge the elastomer roll toward and ultimately into contact with the pinch roll. The cam follower 40, the elastomer roll ER, or some other component connected to rotate with the elastomer roll includes or defines a flag 50, and the subject apparatus includes a corresponding flag sensor 52 adapted to sense movement of the flag 50 therepast. The sensor 52 is operably connected to the controller 30, and the controller is adapted to receive signals from the sensor 52 and to determine: (a) whether the elastomer roll is rotating; and, (b) the period between successive flag sensing events, which is indicative of the rotational speed of the elastomer roll. As is described in full detail below, the controller 30, based upon input from the sensor 52, controls the stepper motor 26 so that the rotational position of the cam 20 varies to alter the position of the elastomer roll ER relative to the pinch roll PR. Those of ordinary skill in the art will recognize that other means for displacing the elastomer roll ER relative to the pinch roll PR can be advantageously employed instead of the cam 20, such as fluid cylinders, gear trains, and any other suitable means.

Figure 4:
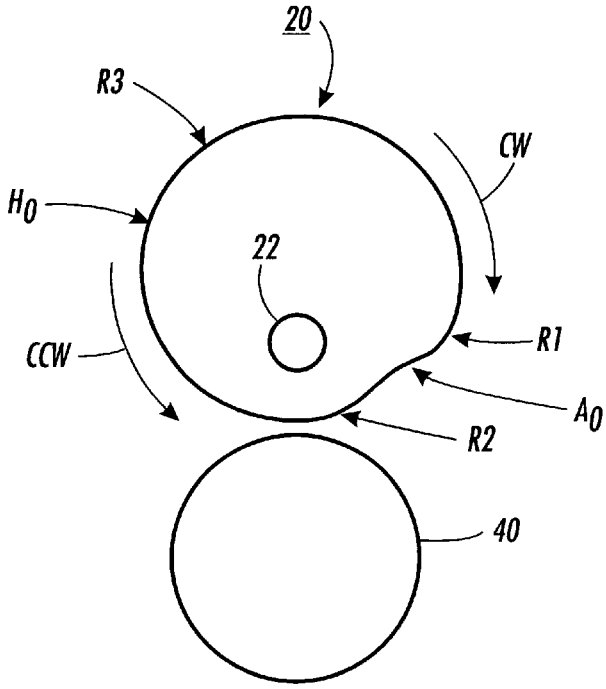
FIG. 4 is an end view of the cam and associated follower used in the apparatus of FIG. 3.

A suitable cam 20 is illustrated in FIG. 4 adjacent the associated follower 40. As noted above, the cam rotates on a shaft 22 in either a first direction CCW or a second direction CW to control the height of the cam 20 located between the shaft 22 and the follower 40. Of course, the cam is defined by a high region R1, a low region R2, and a working region R3 smoothly interconnecting the high and low regions. Those of ordinary skill in the mechanical arts will recognize that rotation of the cam 20 in the first direction CCW will bring a portion of the working region R3 into contact with the follower, and further rotation of the cam in the first direction CCW will then urge the follower away from the cam shaft 22 against the aforementioned biasing force. Of course, rotation of the cam 20 in the opposite, second direction CW will have an opposite effect, until the cam has been rotated sufficiently in the second direction where the high region R1 engages the follower 40.

Figure 5:
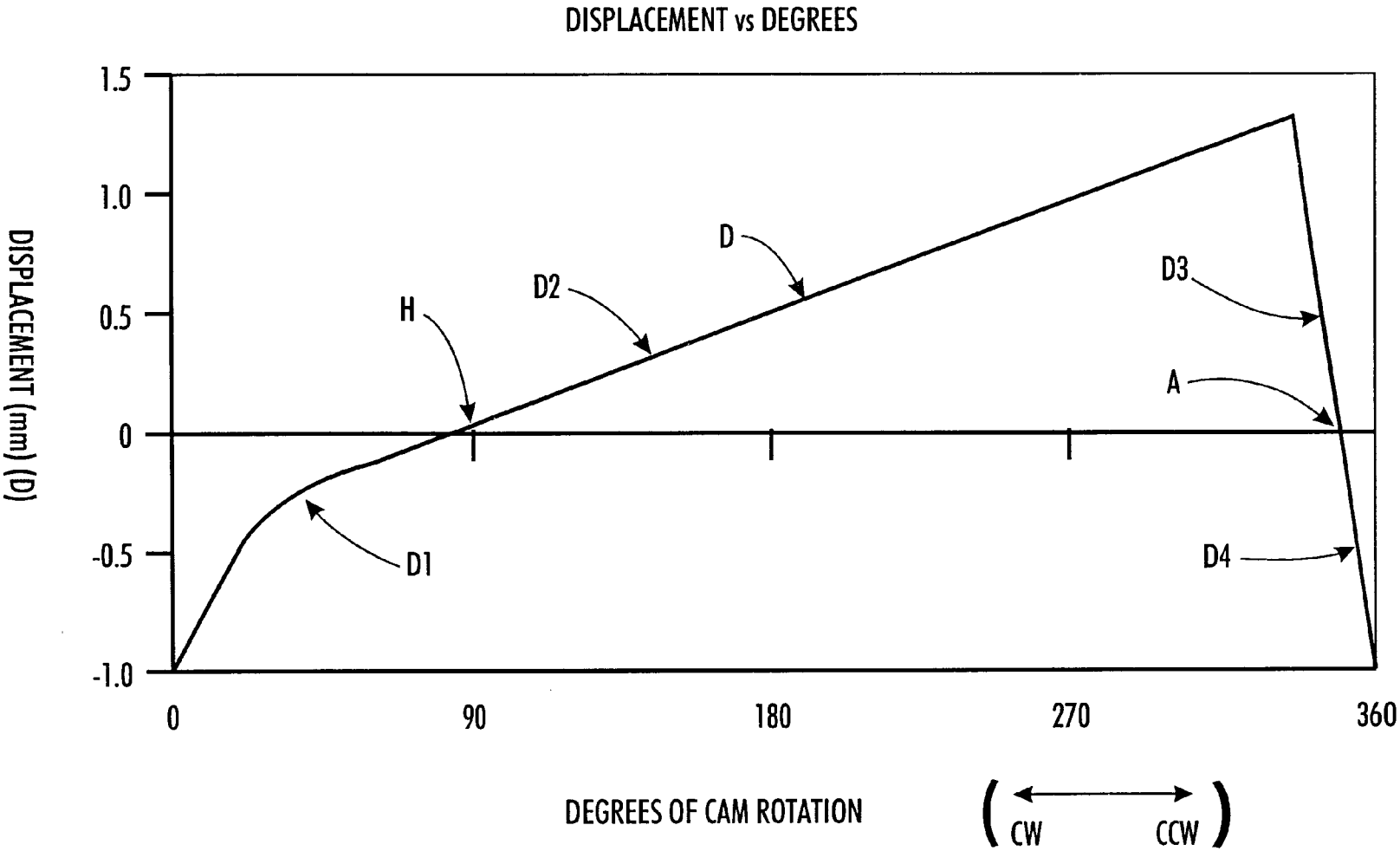
FIG. 5 graphically illustrates displacement of the elastomer roll in millimeters (mm) based upon degrees of rotation of the cam of FIG. 3.

This relationship is graphically illustrated in FIG. 5 wherein the displacement D of the follower 40 (and elastomer roll ER) is plotted as a function of degrees of cam rotation. As illustrated, beginning at 0°, rotation of the cam in the first direction CCW results in increasing displacement D until such time as the follower "falls off" the high region R1 of the cam. For purposes of the present invention, zero millimeterg of displacement (the point where the displacement line graph intersects 0) is the point where an ideal and unworn elastomer roll ER would contact the driven pinch roll and begins to rotate. However, at this point of zero displacement, there would be slippage between the pinch roll and the elastomer roll. Further rotation of the cam 20 in the first direction CCW results in a home displacement level H that occurs when a home position $H_0$ on the cam 20 (FIG. 4) contacts the follower 40. The home position $H_0$ is defined as the position on the cam 20 that, when in contact with the follower 40, results in displacement of the elastomer roll ER to a point where it is both: (i) in contact with the pinch roll PR and being driven thereby at a maximum speed, i.e., with a minimum period for successive sensing events of the flag 50 by the sensor 52; and, (ii) with minimal penetration of the pinch roll PR into the elastomer roll ER so that little or no sheet decurling would take place. In this home position of the cam and elastomer roll, paper or other sheets S will be transported between the pinch roll and the elastomer roll with minimal or no decurling effect. At displacement levels less than zero, i.e., the regions D1 and D4 of the displacement line graph, the ideal, unworn elastomer roll ER will not contact and be driven by the pinch roll PR. On the other hand, displacement levels greater than zero, i.e., the regions D2 and D3 of the displacement line graph, the ideal, unworn elastomer roll contacts the pinch roll and rotates.

With brief reference again to FIG. 4, the point on the cam working region R3 that places the elastomer roll ER in the home position is defined as the home position $H_0$. Similarly, the point on the cam 20 that moves the level of elastomer roll displacement D from the non-rotating region D4 to rotating region D3 (corresponding to point A in FIG. 5) when the cam is rotating in the second direction CW is known as the cam reference point position $A_0$. As described below, the present invention controls pinch roll penetration and monitors wear of the elastomer roll ER based upon identifying and monitoring these cam position. Owing to the fact that the stepper motor 26 is an open-loop device, the location of these positions on the cam 20 must be derived independently.

Figure 6:
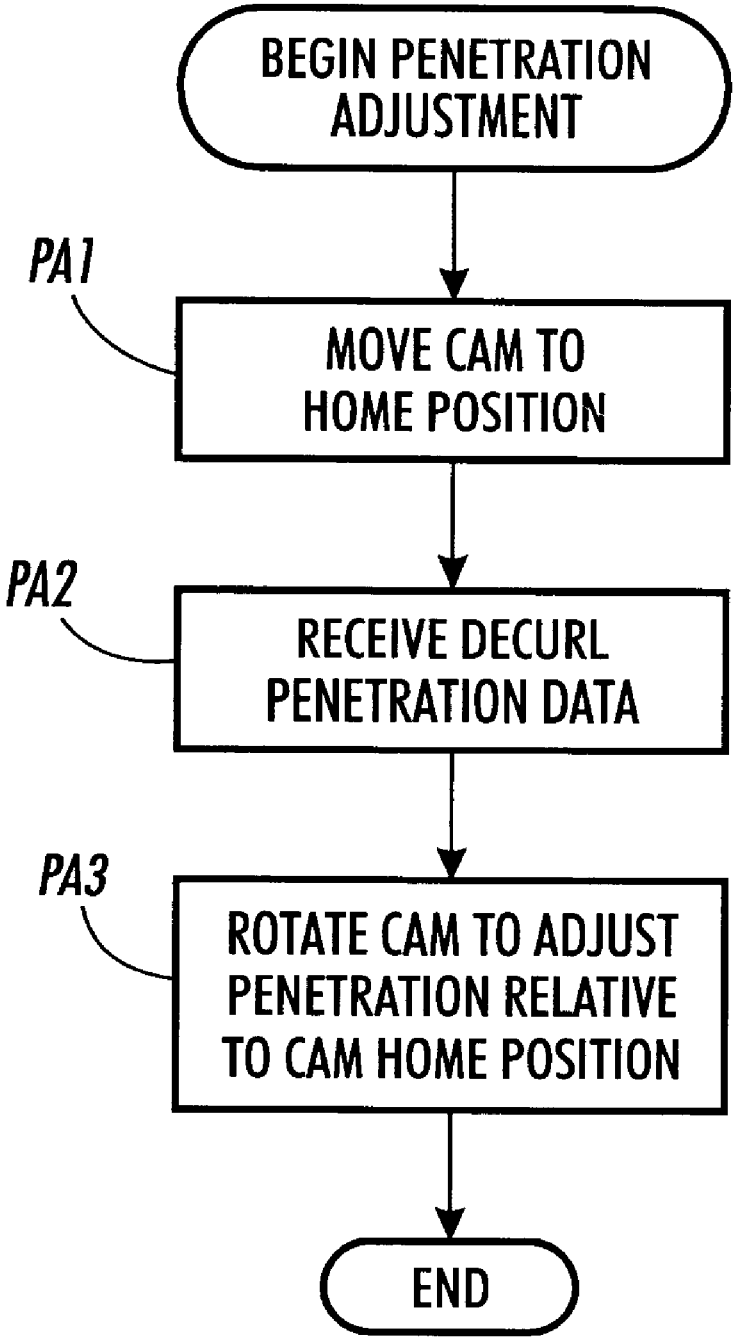
FIG. 6 is a flow chart that defines a method for controlling pinch roll penetration in accordance with the present invention.

Turning now to FIG. 6, the overall method of adjusting pinch roll penetration in accordance with the present invention is illustrated. The algorithms for carrying out the methods in accordance with the present invention are stored in the memory areas MEM and/or NVM. Again, while the present invention is described with reference to using the cam 20 and follower 40 to displace the elastomer roll ER, those of ordinary skill in the art will recognize that the pinch roll PR could alternatively or additionally be displaced to control pinch roll penetration without departing from the overall scope and intent of the present invention.

As shown in FIG. 6, an initial step PA1 includes using the controller 30 and stepper motor 26 to rotate the cam 20 until the home position $H_0$ is acting on the follower 40. For step PA2, the controller 30 derives or receives sheet decurling penetration data for decurling a particular sheet. Step PA3 is defined by the controller 30 operating the stepper motor 26 to rotate the cam 20 to adjust pinch roll penetration from the home cam position, which will vary due to tolerance stack up and wear, to the penetration depth defined by the received penetration data. Those of ordinary skill in the art will recognize that, owing to the fact that pinch roll penetration is adjusted relative to the home cam position, undesirable tolerance stack-up in the various components does not prevent accurate adjustment of pinch roll penetration.

Figure 7:
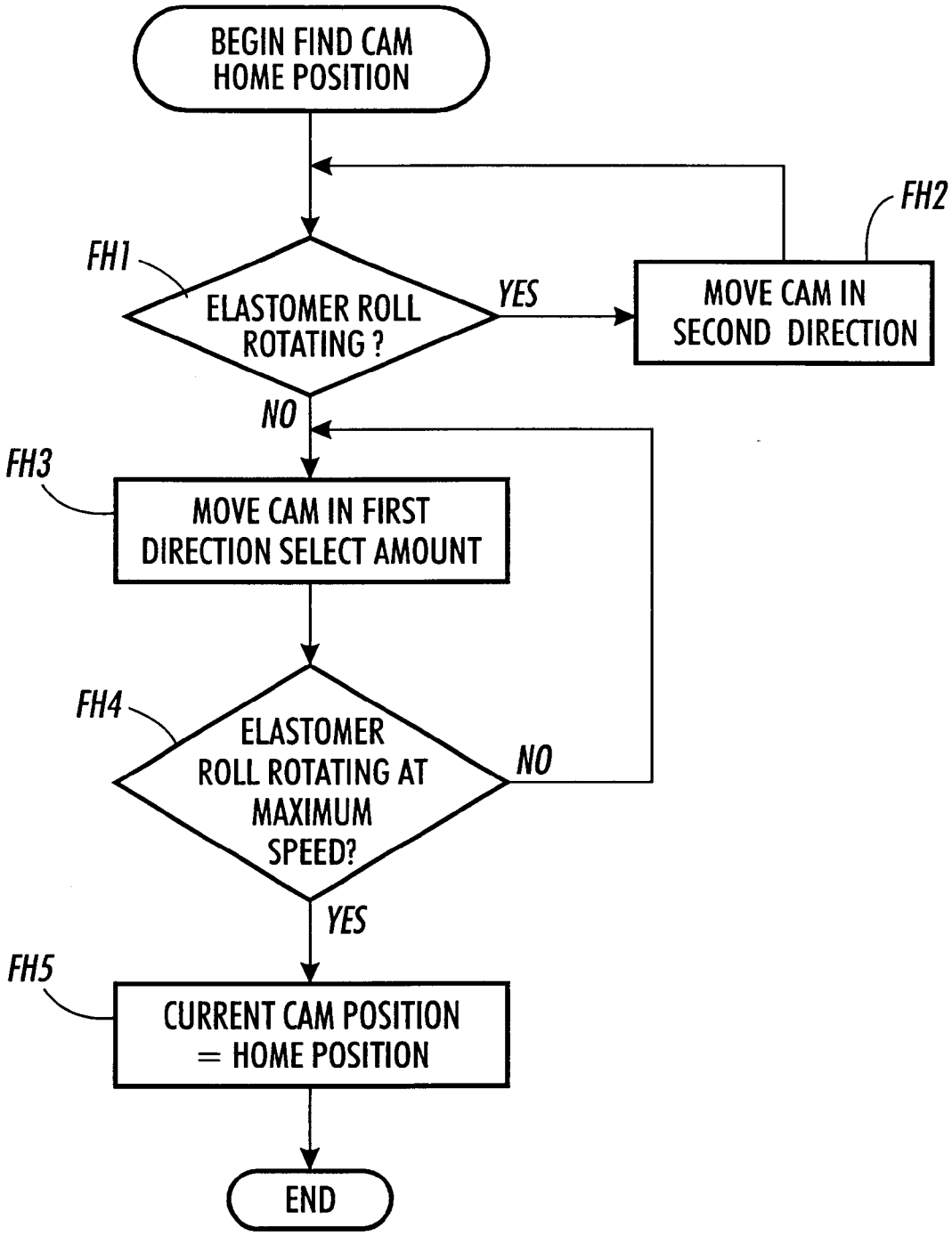
FIG. 7 is a flow chart defining a method of determining a home position on the cam of FIGS. 3 and 4 in accordance with the present invention.

Of course, the penetration adjustment method disclosed in FIG. 6 requires an accurate determination of the home position $H_0$ on the cam 20. To reiterate, the home position $H_0$ is the position on the cam that, when in contact with the follower 40, results in the elastomer roll being driven by the pinch roll with a minimum period and little or no sheet decurling. FIG. 7 illustrates a method for identifying the home position $H_0$ on a cam without regard to tolerance stack-up, elastomer roll wear, or other variables. The method comprises an initial step FH1 of using the sensor 52 and flag 50 to determine if the elastomer roll ER is rotating. If so, the step FH2 is carried out to rotate the cam 20 in the second direction CW and step FH1 is repeated until the elastomer roll ER is not rotating. If the elastomer roll ER is not rotating, or after step FH2 is carried out once or more to disengage the elastomer roll ER from the pinch roll PR, the step FH3 is carried out by moving the cam in the first direction CCW a select amount. After step FH3, a step FH4 is carried out to determine if the elastomer roll ER is rotating at a predefined ideal speed for the home position $H_0$. In particular, the sensor 52 senses movement of the flag 50, if any, and provides a period signal to the controller 30. The controller compares the period represented by the period signal with a predefined minimum period indicative of the home cam position $H_0$. If, according to the step FH4, the elastomer roll is not rotating at the ideal speed, control returns to step FH3. If, according to step FH4, the elastomer roll is rotating at the ideal speed for the home position, a step FH5 is carried out to identify the corresponding cam position as the home position $H_0$. With this home position, the controller 30 can control the stepper motor 26 to carry out steps PA1–PA3 of the penetration adjustment method described in relation to FIG. 6.

Owing to the fact that the elastomer roll ER will wear over time, the steps FH1–FH5 are preferably carried out regularly and periodically, e.g., at every machine power up, after a select number of sheets have been decurled, and/or according to any other routine. With reference again to the graph of FIG. 5, those of ordinary skill in the art will recognize that, as the elastomer roll wears, the point on the displacement line corresponding to the home position $H_0$ of the cam will shift upwardly, i.e., the cam 20 will need to rotate further in the first direction CCW to reach the home position where the elastomer roll ER is rotating with a minimum period. Without periodically finding a new home position, pinch roll penetration adjustments based upon the original home position would be erroneous.

Based upon the foregoing, those of ordinary skill in the art will recognize that if movement of the home position $H_0$ on the cam 20 could be monitored relative to a second known position on the cam, the wear of the elastomer roll ER could be ascertained, and a wear rate, based upon wear and the number of sheets handled or the like, could be derived. The present invention preferably identifies and uses the reference point position $A_0$ as the second, known position. Derivation of the wear rate in accordance with the present invention provides an ability to predict the end of the useful life of the elastomer roll ER and to notify an operator of the image forming apparatus of same in advance before a malfunction. The elastomer roll ER can be said to be spent after it has worn sufficiently so that the cam 20 is unable to displace the elastomer roll sufficiently to reach the home position and all possible penetration depths.

Figure 8:
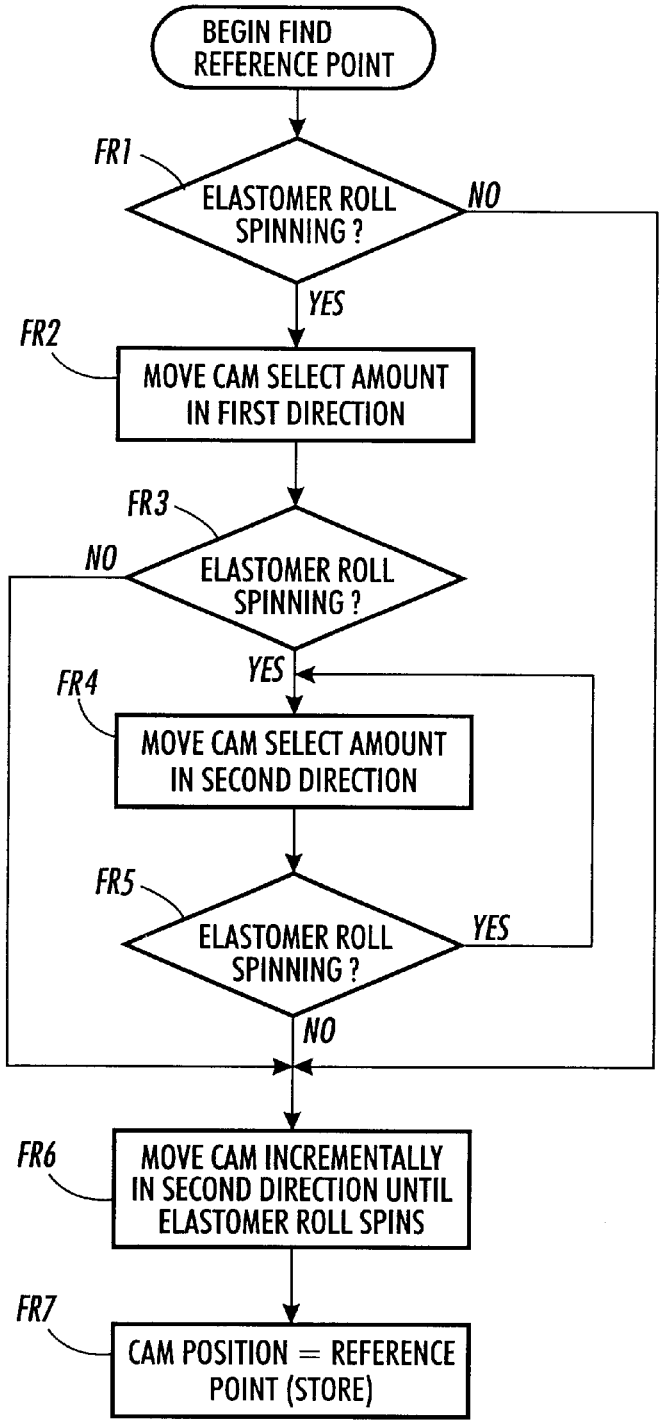
FIG. 8 is a flow chart defining a method of determining an absolute reference point ($A_0$) on the cam of FIGS. 3 and 4 in accordance with the present invention; and, FIG. 9 is a flow chart defining a method of assessing the wear rate of the elastomer roll of FIG. 3, for predicting an end of the useful life of the roll, and for notifying a user of the associated image forming apparatus that a new roll is required prior to failure of the roll.

FIG. 8 details a procedure for finding the reference point position $A_0$, on the cam 20. It should be recognized that, once the reference point position $A_0$ is identified, its location can be stored in the non-volatile memory NVM for use. A step FR1 is carried out to determine, using the sensor 52, if the elastomer roll ER is spinning. If it is, a step FR2 is carried out to move the cam in the first direction CCW and a step FR3 is carried out to determine if the elastomer roll is still spinning. If, according to the step FR3, the elastomer roll ER is spinning (indicative of the cam working region R3 acting on the follower 40), the steps FR4 and FR5 are carried out to move the cam repeatedly a select amount in the second direction until the elastomer roll stops spinning. Then, a step FR6 is carried out to move the cam in the second direction CW further in stages until the elastomer roll ER once again begins to spin (indicative of the reference point position $A_0$ of the cam acting on the follower 40). A step FR7 is carried out in the controller 30 to note the reference point position $A_0$ in terms of the step position for the motor 26 and store same in the non-volatile memory NVM. If, on the other hand, the elastomer roll is not spinning as determined by the initial step FR1, control passes directly to the step FR6. In general, it can be seen that the foregoing procedure results in the identification of the reference point position $A_0$ the surface of the cam 20.

Figure 9:
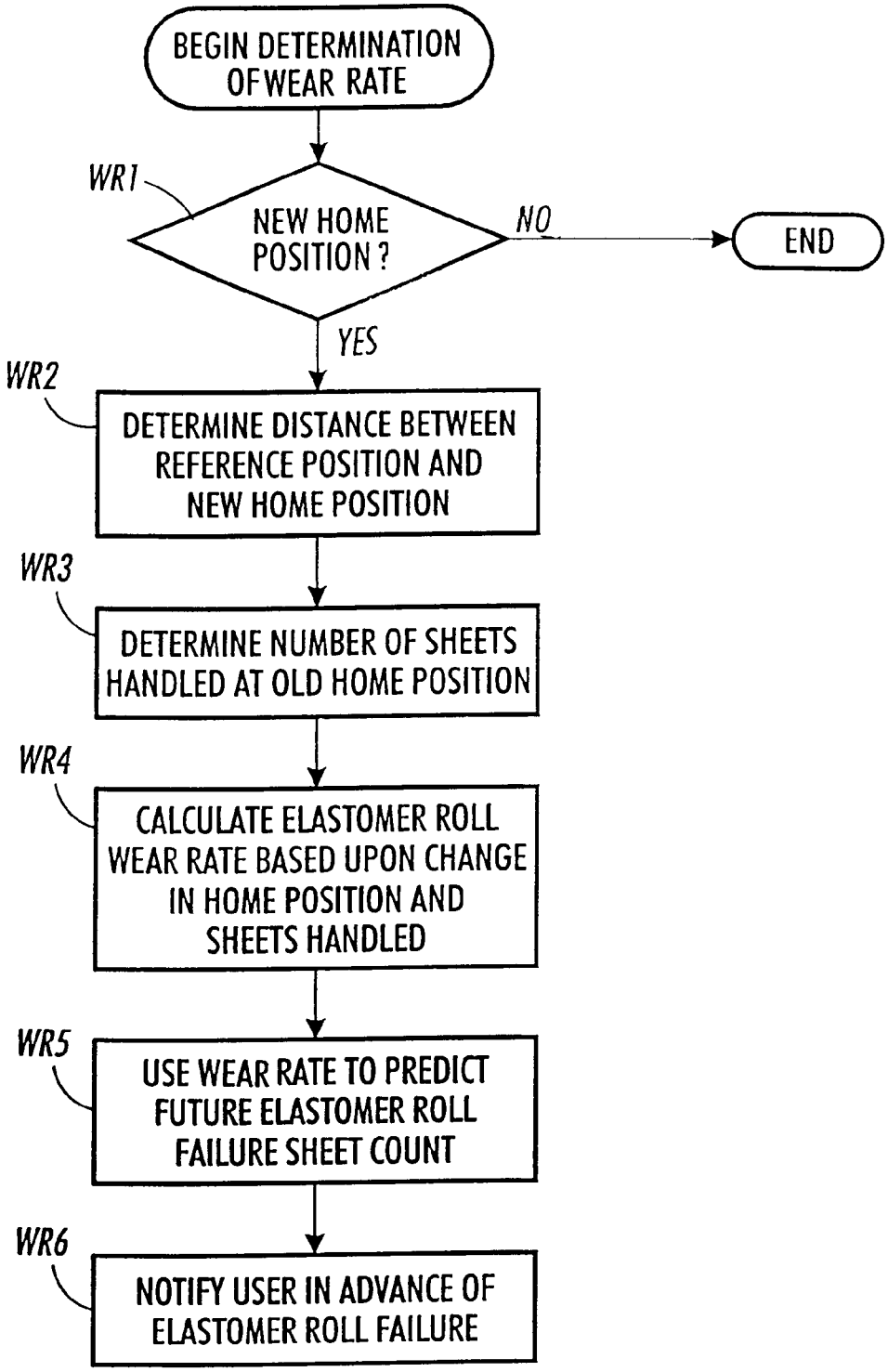

FIG. 9 details a procedure for using the reference point position $A_0$ and the movement of the home position $H_0$ over use to derive the wear rate of the elastomer roll ER and to predict failure of same. As illustrated, the wear rate of the elastomer roll is preferably calculated every time a new home position $H_0$ is established. Thus, a step WR1 determines if a new home position has been established and, if so, a step WR2 is carried out to determine the distance (e.g., in terms of steps of the motor 26) between the reference point position $A_0$ and the new home position $H_0$. A step WR3 is executed to determined the number of sheets decurled at the previous home position $H_0$, and a step WR4 is carried out to derive the elastomer roll wear rate according to the following formula:

$$\text{Wear Rate} = \frac{\text{change in distance between } A_0 \text{ and } H_0}{\text{change in decurled sheet count}}$$

A step WR5 uses the derived wear rate together with the known failure point of the elastomer roll (i.e., the point where it is so worn that it cannot be displaced as required to accommodate a new home position and all required pinch roller penetration amounts) to predict a future sheet count for failure of the elastomer roll ER. A step WR6 is carried out to notify an operator of the image forming apparatus, by way of the user interface, that a new elastomer roll ER is required in advance of actual failure of elastomer roll ER when the actual current sheet count through the decurler approaches the failure sheet count.

The present invention has been described with reference to preferred embodiments. Alterations and modifications will occur to those of ordinary skill in the art upon reading and understanding the specification, and it is intended that the invention encompass all such modifications and alterations insofar as they fall within the scope of the appended claims and equivalents.

Having thus described the preferred embodiments, what is claimed is:

1. In a nip-forming apparatus including a first roll and a second roll, wherein one of the rolls is displaceable toward the other to control the position of the first roll relative to the second roll, and wherein one of rolls is driven and the other is rotatable, a setup procedure method comprising:

rotating said driven roll;

sensing a rotational speed of the rotatable roll;

while said driven roll is rotating, displacing the displaceable roll to a home displacement position relative to the other roll, said home displacement position corresponding to a displaced position of said displaceable roll where said rotatable roll rotates at a select speed in response to contact with said driven roll; and, recording the home displacement position.

2. The setup procedure method as set forth in claim 1, wherein said step of rotating said driven roll comprises rotating said first roll.

3. The setup procedure method as set forth in claim 2, wherein said step of displacing the displaceable roll comprises displacing said second roll.

4. The setup procedure method as set forth in claim 1, wherein said select speed is defined as the maximum achievable rotational speed of the rotatable roll in response to contact with said driven roll.

5. The setup procedure method as set forth in claim 1, wherein said step of displacing the displaceable roll to a home displacement position relative to the other roll comprises using a stepper motor to rotate a cam that acts on a follower connected to said displaceable roll to a home cam position, and wherein said step of recording the home displacement position comprises recording a step position for said stepper motor that corresponds to the home cam position.

6. A method of controlling a decurling apparatus that comprises a cylindrical pinch roll and a cylindrical second roll, said method comprising:

(a) driving one of said rolls about a longitudinal axis;

(b) moving one of said rolls into contact with the other of said rolls to a select home position where said driven roll contacts and rotates the other roll at a select speed;

(c) recording said home position;

(d) moving said rolls relative to said home position at least one of toward and away from each other to control an amount by which a harder one of said rolls penetrates a softer one of said rolls to control an amount of decurling in a sheet that passes between said rolls.

7. The method as set forth in claim 6, further comprising periodically repeating steps (a)–(c) to identify and record a new home position, and wherein step (d) comprises:

moving said rolls relative to said new home position at least one of toward and away from each other to control an amount by which a harder one of said rolls penetrates a softer one of said rolls to control an amount of decurling in a sheet that passes between said rolls.

8. The method as set forth in claim 7, further comprising, for multiple repetitions of said steps (a)–(c):

maintaining a wear record of a change in distance between said home position and said new home position; and, using said wear record and a record of sheets handled by said decurling apparatus to derive a wear rate for the softer one of said rolls.

9. The method as set forth in claim 8, further comprising:

using said wear rate to predict a future count of sheets handled by said decurling apparatus that will result in said softer one of said rolls being worn beyond its useful life.

10. The method as set forth in claim 9, further comprising:

comparing said future count of sheets to a present count of sheets handled by said decurling apparatus; and, before said present count equals said future count, notifying an operator of said apparatus to replace at least said softer one of said rolls.

11. An apparatus for controlling a decurling apparatus that comprises a cylindrical pinch roll and a cylindrical second roll, said apparatus comprising:

means for driving one of said rolls about a longitudinal axis;

means for moving one of said rolls into contact with the other of said rolls to a select home position where said driven roll contacts and rotates the other roll at a predetermined select speed;

means for recording said home position; and, means for moving said rolls relative to said home position at least one of toward and away from each other to control an amount by which a harder one of said rolls penetrates a softer one of said rolls to control an amount of decurling in a sheet that passes between said rolls.

12. The apparatus as set forth in claim 11, further comprising:

means for adjusting said home position to compensate for wear of said softer one of said rolls;

means for maintaining a wear record indicative of changes in said home position; and, means for using said wear record and a record of sheets handled by said decurling apparatus to derive a wear rate for the softer one of said rolls.

13. The apparatus as set forth in claim 12, further comprising:

means for using said wear rate to predict a future count of sheets handled by said decurling apparatus that will result in said softer one of said rolls being worn beyond its useful life.

14. The apparatus as set forth in claim 13, further comprising:

means for comparing said future count of sheets to a present count of sheets handled by said decurling apparatus; and, means for notifying an operator of said apparatus to replace at least said softer one of said rolls when said present count is a select percentage of said future count.

* * * * *